US007878041B2

(12) United States Patent
Álvarez

(10) Patent No.: US 7,878,041 B2
(45) Date of Patent: Feb. 1, 2011

(54) DYNAMIC VERIFICATION METHOD FOR A RIVETING PROCESS WITH BLIND RIVETS CARRIED OUT WITH AN AUTOMATIC RIVETING APPARATUS, AND VERIFYING DEVICE FOR CARRYING OUT THE VERIFICATION

(75) Inventor: Desiderio Sánchez-Brunete Álvarez, Madrid (ES)

(73) Assignee: Airbus Operations, S.L., Getafe (Madrid) (ES)

( * ) Notice: Subject to any disclaimer, the term of this patent is extended or adjusted under 35 U.S.C. 154(b) by 346 days.

(21) Appl. No.: 12/073,522

(22) Filed: Mar. 6, 2008

(65) Prior Publication Data

US 2008/0250832 A1 Oct. 16, 2008

(30) Foreign Application Priority Data

Apr. 10, 2007 (ES) ..... 200700936

(51) Int. Cl.
*B23Q 17/00* (2006.01)
*B21J 15/28* (2006.01)
*B23P 11/00* (2006.01)

(52) U.S. Cl. ..... 72/391.4; 72/21.1; 72/21.4; 29/243.523; 29/243.524; 29/243.525; 29/407.08; 29/407.05; 29/407.1; 29/525.06

(58) Field of Classification Search ..... 72/391.4–391.6, 72/21.1, 21.4; 29/243.521–243.525, 407.08, 29/407.05, 407.1, 525.06
See application file for complete search history.

(56) References Cited

U.S. PATENT DOCUMENTS 5,035,353 A * 7/1991 Smart et al. ..... 72/391.6
5,661,887 A * 9/1997 Byrne et al. ..... 29/243.525
5,666,710 A * 9/1997 Weber et al. ..... 29/243.523
7,055,393 B2 * 6/2006 Smith ..... 73/774
7,343,764 B2 * 3/2008 Solfronk ..... 72/20.1
7,346,971 B2 * 3/2008 Chitty ..... 29/243.523
7,503,196 B2 * 3/2009 Chitty et al. ..... 72/21.4
7,536,764 B2 * 5/2009 Weeks et al. ..... 72/391.4
2005/0217097 A1 10/2005 Solfronk

FOREIGN PATENT DOCUMENTS

EP 0 738 551 10/1996
ES 2 234 394 6/2005

OTHER PUBLICATIONS

Spanish Search Report issued Jul. 2010 in counterpart Spanish application.

* cited by examiner

*Primary Examiner*—David B Jones
(74) *Attorney, Agent, or Firm*—Wenderoth, Lind & Ponack L.L.P.

(57) ABSTRACT

A method and device are provided for verification of the quality of placing of blind rivets. The verification method involves successively carrying out, during the application of traction force to a stem, initial measurements in an initial state of the application of the traction force to obtain an initial traction force and an initial displacement of the rivet stem relative to the rivet body, intermediate measurements in an intermediate stage of the application of the traction force to obtain an intermediate traction force and an intermediate displacement, and terminal measurements in a terminal stage of the application of the traction force to obtain a terminal traction force and a terminal displacement. The obtained values are compared to acceptable values in an assignment table.

16 Claims, 8 Drawing Sheets

| | | | | | 10 | 7 | |
|---|---|---|---|---|---|---|---|
| A | 4 | | AA | AA1 | | aa1 | a |
| | 5 | | AB | AB1 | | ab1 | |
| B | 4 | | BA | BA1 | | ba1 | b |
| | 5 | | BB | BB1 | | bb1 | |
| | 4 | 9 | 2BA | BA2 | 6c | ba2 | |
| | 5 | | 2BB | BB2 | | bb2 | |
| | ... | | ... | ... | | ... | |
| | ... | | ... | ... | | ... | |
| | 4 | | nBA | BAn | | ban | |
| | 5 | | nBB | BBn | | bbn | |
| C | 4 | | CA | CA1 | | ca1 | c |
| | 5 | | CB | CB1 | | cb1 | |

*FIG. 6*

| | | | 9 | | 6c | 7 | | |
|---|---|---|---|---|---|---|---|---|
| A | 4 | AA | | AA1 | | aa1-min<br>aa1-max | ad | a |
| | 5 | AB | | AB1 | | ab1-min<br>ab1-max | ac | |
| B | 4 | BA | | BA1 | | ba1(min)<br>ba1(max) | bd1 | b |
| | 5 | BB | | BB1 | | bb1(min)<br>bb1(max) | bc1 | |
| | 4 | 2BA | | BA2 | | ba2(min)<br>ba2(max) | bd2 | |
| | 5 | 2BB | | BB2 | | bb2(min)<br>bb2(max) | bc2 | |
| | ... | ... | | ... | | ... | ... | |
| | ... | ... | | ... | | ... | ... | |
| | 4 | nBA | | BAn | | ban(min)<br>ban(max) | bdn | |
| | 5 | nBB | | BBn | | bbn(min)<br>ban(max) | bcn | |
| C | 4 | CA | | CA1 | | ca1-min<br>ca1-max | cd | c |
| | 5 | CB | | CB1 | | cb1-min<br>cb1-max | cc | |

*FIG. 7*

DYNAMIC VERIFICATION METHOD FOR A RIVETING PROCESS WITH BLIND RIVETS CARRIED OUT WITH AN AUTOMATIC RIVETING APPARATUS, AND VERIFYING DEVICE FOR CARRYING OUT THE VERIFICATION

TECHNICAL FIELD OF THE INVENTION

The present invention belongs to the field of riveting technology for blind rivets and is particularly applicable to the sector of automatic riveting stations which requires great precision and reliability in the riveting finishings, such as for example the aeronautical industry.

PRIOR ART OF THE INVENTION

The problem associated with the manufacture of structures closed with pieces joined by riveting, for example torsion boxes introduced in the structure, is well known, since it is not possible to use hi-lock type (nut and bolt) rivets due to the fact that the rear parts of the riveted pieces are not accessible. Therefore, in order to rivet this type of structure one usually uses blind rivets which only need access from one side in order to be applied.

A blind rivet consists of a body with an interior passage, a deformable free end part and an end part with a rivet head in the form of a collar, together with a stem displaceable in said interior passage by application of a traction force. The stem comprises a stem body with a free end that projects from the rivet head and an end with a stem head which has a dimension greater than said interior passage but no greater than the contour of the first free part of the rivet body and which, prior to application of the rivet, projects from the free end part of the rivet body.

In order to attach pieces by means of blind rivets, first the rivet body is inserted via its free end part in a drill-hole passing through the internal piece and the external piece which have to be joined in such a way that the end part projects from the interior piece and the collar of the rivet head remains resting on the external piece. A traction force, known as a "pull", is then applied to the free end of the stem of the blind rivet by means of a riveting apparatus which simultaneously presses the collar against the exterior piece so that the head of the stem enters into the interior passage of the free end part of the body of the rivet deforming the free end part until it becomes widened beyond the contour of the free end part of the body of the rivet found in the drill-hole and until that free end part wraps and press the head of the stem. After that, at least part of the body of the stem is then separated from the head of the stem.

The problem existing in the use of blind rivets lies in, among other things, the fact that once the rivet has been attached, there is no possibility of gaining access in order to inspect whether the free end part of the rivet has really trapped the head of the stem correctly or not, and therefore of not knowing whether the rivet has been placed correctly or not. In order to solve this problem systems have been developed such as traction rivets with a threaded stem and traction nut that breaks at a calibrated stress and, in so doing, determines the quality of the join. Nevertheless, these rivets are relatively costly and their reliability in terms of the possibility of detecting the incorrect placing of a rivet is less than desirable. These drawbacks have a special effect on the aeronautical industry since a very large number of rivets is used in the manufacture of aircraft and their correct placing is crucial for guaranteeing the safety of the aircraft.

It was therefore desirable to have a technology that would solve the problems inherent in the verification of the quality of the placing of blind rivets and which would permit a verification that would provide a certainty of the quality of it instantly after each riveting.

DESCRIPTION OF THE INVENTION

The aim of the present invention is to solve the problems inherent in the verification of the quality of the placing of blind rivets by means of a verification method and a verifying device for carrying out the method whose characteristics are going to be described below.

In accordance with the invention, the verification method comprises successively carrying out, during the application of the traction force to the stem, some initial measurements in an initial stage of the application of the traction force, some intermediate measurements in an intermediate stage of the application of the traction force and some terminal measurements in a terminal stage of the application of the traction force.

The initial measurements consist of an initial measurement of the traction force in order to obtain an initial value of traction force, and simultaneously an initial measurement of the displacement of the stem with respect to the body of the rivet in order to obtain an initial value of displacement, while the intermediate measurements consist of at least one intermediate measurement of the traction force in order to obtain an initial value of traction force, and simultaneously an initial measurement of the displacement of the stem with respect to the body of the rivet in order to obtain an intermediate value of displacement. In turn, the final measurements consist of a terminal measurement of the traction force in order to obtain a terminal value of traction force, and simultaneously a terminal measurement of the displacement of the stem with respect to the body of the rivet in order to obtain a terminal value of displacement. The measurements of the traction forces are done by means of a traction force meter connected to the riveting apparatus and the displacement measurements are made by means of a displacement meter connected to the riveting apparatus. Each traction value measured and each displacement value measured are transmitted to data processing means.

The data processing means are provided with a memory in which is stored a type assignment table. The type assignment table consists of type values referring to a type rivet corresponding to the riveting being carried out with a standard blind rivet corresponding to the blind rivet being applied, by means of a standard riveting apparatus corresponding to the riveting apparatus being used. Those type values in the assignment table include at least one initial type value of displacement assigned to at least one initial type value of traction force applied in an initial type stage, at least one intermediate type value of displacement assigned to at least one intermediate initial type value of traction force applied in an intermediate type stage, along with at least one terminal type value of displacement assigned to at least one terminal type value of traction force. The assignment table can, with respect to each initial type value of displacement, include an initial type value of minimum displacement and an initial type value of maximum displacement which between them define the acceptable initial interval of initial type values of displacement, and an initial type value of minimum traction force and also, with respect to each initial type value of traction force, a type value of maximum initial traction force which between them define the acceptable initial interval of initial type values of traction force. Moreover, and with respect to each intermediate type value of displacement, the assignment table can include an intermediate type value of minimum displacement and an intermediate type value of maximum displacement which define an acceptable intermediate interval of intermediate type values of displacement, and an intermediate type value of minimum traction force and also, with respect to each intermediate type value of traction force, an type value of maximum intermediate traction force which define the acceptable intermediate interval of intermediate type values of traction force. Finally, and with respect to terminal type value of displacement, the assignment table can include a terminal type value of minimum displacement and a terminal type value of maximum displacement which define an acceptable terminal interval of terminal type values of displacement, and a terminal type value of minimum traction force and also, with respect to each terminal type value of traction force, a type value of maximum terminal traction force which define the acceptable terminal interval of terminal type values of traction force.

By means of the data processing means, a comparison is then respectively made of the measured initial values, the measured intermediate values and the measured terminal values with the initial type values, the intermediate type values and the terminal type values contained in the assignment table, with a signal being given of each measured value which does not coincide with at least one corresponding type value or when the measured initial values, the measured intermediate values and the measured terminal values are respectively compared with the acceptable initial values, the acceptable intermediate values and the acceptable terminal values contained in the assignment table, and a signal is given of at least each measured value which does not coincide with at least one type value covered by those acceptable intervals in the assignment table.

The assignment table can furthermore contain a plurality of consecutive intermediate type values of displacement assigned to respective consecutive intermediate type values of traction force consecutively applied in the intermediate type stage. In this embodiment, in the intermediate stage of application of the traction force, a plurality of successive intermediate measurements of displacement are taken in order to obtain a plurality of successive intermediate values of displacement, and simultaneously with each of the intermediate measurements of displacement, each intermediate measurements of traction force are made in order to obtain each intermediate values of traction force. The successive intermediate values that are measured are compared with the consecutive intermediate type values of the assignment table, and a signal is given if at least one intermediate value that is measured which does not coincide with at least one corresponding intermediate type value.

Moreover, the verifying device of the present invention which can be used for embodying the method of this invention consists of a traction force sensor connected to the riveting apparatus in order to measure successive values of a traction force applied to a stem of a blind rivet, a displacement sensor connected to the riveting apparatus for measuring successive values of the displacement of the stem of the blind rivet to which the traction force is applied with respect to the body of the blind rivet, and transmitter means for transmitting the values measured by the sensors to data processing means which consist of a memory in which is stored at least one type assignment table like the one described above with respect to the verification method of the present invention. The device furthermore includes controlling means for ordering the displacement sensors and the traction force sensors to simultaneously carry out the successive initial, intermediate and terminal measurements during the application of the traction force to the stem, comparing means for respectively comparing the initial measured values, the intermediate measured values and the terminal measured values with the initial type values, the intermediate type values and the terminal type values contained in the assignment table, and means of signalling in order to signal at least each measured value that does not coincide with at least one corresponding type value.

In addition, the device can include generating means for graphic representations in order to generate a graphic representation of the values measured in the riveting of each blind rivet in a system of coordinates that includes a first coordinate of displacement values and a second coordinate of traction force values, along with means of generation of an alert signal, for example, in the form of acoustic signals, visual signals and combinations of them, which generate an alert signal when a measured values does not coincide with at least one corresponding type value. The generating means for graphic representations can furthermore be adapted to generate in the said system of coordinates a graphic representation of the type values contained in the type assignment table.

The graphic representations generated by the generating means for graphic representations can be curves, both in terms of the measured values and in terms of the type values. When the graphic representation of the values measured during the riveting and of the measured values consists of curves, these curves can be discerned visually and a determination can be made of when the curve of the measured values corresponds to the curve of the type values or lies between the curve of the minimum and maximum type values, in which case the riveting has been carried out correctly.

The present invention can be implemented in various different environments, such as for example in systems habitually used in the aeronautical industry based on a robot or numerical control system with sufficient precision, repetitiveness and rigidity, duly programmed for locating itself in front of the unit to rivet, which already has the drill-holes previously made under the required conditions and which incorporates the mechanism (independent of the above) which couples the rivet, introduces it and perpendicularly adjusts it to the surface and fires the traction mechanism for the stem, provided with a positioning device based on a PC plus PLC, which contains the positioning control software with analogue and logic inputs and outputs, normally linked to the actual control of the robot or similar. The verifying device of the present invention can be incorporated into the already existing system by means of connection of the displacement meter to be included in the traction system, and of the stress meter likewise applied to that mechanism, to an additional data acquisition card, and compatible with the computing tools already existing in the system and commercial software for analysis of the inputs corresponding to the measurements which will classify the results and store data.

From the foregoing it is revealed that the present invention permits the effective checking in real time and in situ of the state of the blind rivets applied, and permits the generation of either a results report at the end of a programmed task or signals and/or actions during and/or after each riveting. To achieve this, each of the results will be able to be associated with a reference code for each rivet, corresponding to the code of the rivet used to position each of them.

BRIEF DESCRIPTION OF THE DRAWINGS

Explained below are aspects of the invention on the basis of some attached drawings in which

FIG. 6 schematically shows a first embodiment of the interaction of the components of the inventive device with the measured values and the type values in a first embodiment of the present invention;

FIG. 7 schematically shows a second embodiment of the interaction of the components of the inventive device with the measured values and the type values in a second embodiment of the present invention;

Figure 1:
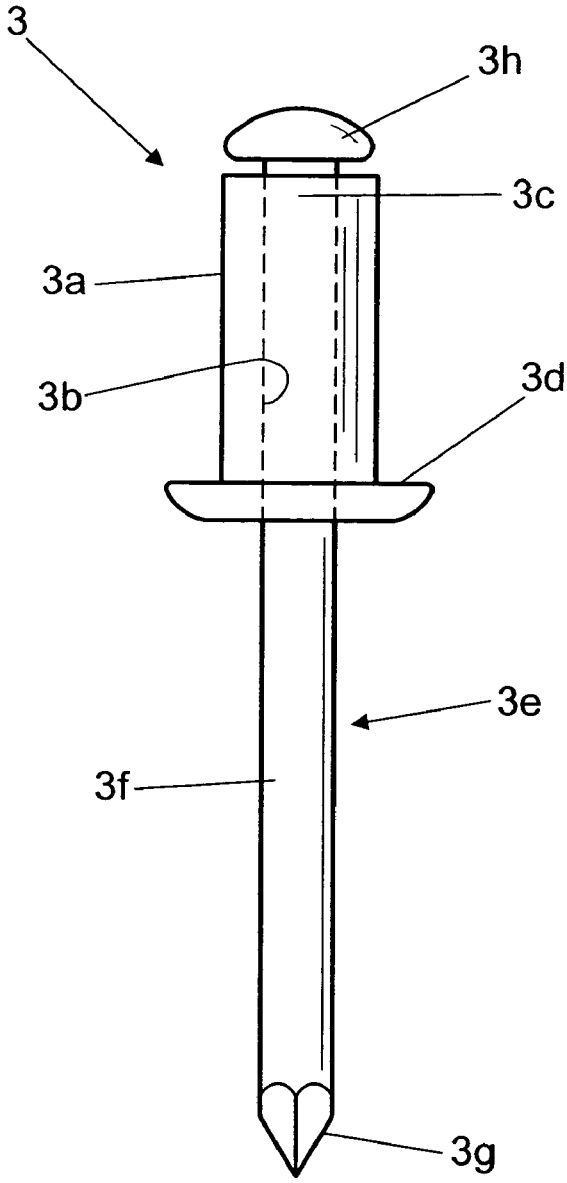
FIG. 1 is a schematic view in side elevation of a blind rivet of the type to which the method and device of the present invention are applied.

Appearing in these figures are reference numbers having the following meanings:

1 automatic riveting facility
1*a* riveting apparatus
1*b* securing mechanism
1*c* traction rod
2*a* internal piece
2*b* external piece
2*c* drill-hole
3 blind rivet
3*a* body of the rivet
3*b* interior passage of the rivet
3*c* deformable free end part of the rivet
3*d* head of the rivet in the form of a collar
3*e* stem of the rivet
3*f* body of the stem
3*g* free end of the stem
3*h* head of the stem
4 traction force meter
4*a* electrical connection of the traction force meter
4*b* displaceable rod
4*c* union arm
4*d* coupling element
5 displacement meter
5*a* electrical connection of the displacement meter
6 data processing means
6*a* memory
6*b* controlling means
6*c* comparing means
7 type assignment table
8 verifying device
9 transmission means
10 signalling means
11 generator means for graphic representations
12 means of generation of an alert signal
13 monitor
13*a* monitor screen
13*b* monitor loudspeaker
13*c* indicator light for confirmation of correct location of the rivet
13*d* indicator light alert for incorrect location of the rivet
14 control unit
15 robot A initial stage of the application of the traction force;
a initial type stage
AA initial measurement of traction force
AA1 initial value of traction force
aa1 initial type value of traction force
aa1-max type value of maximum initial traction force
aa1-min type value of minimum traction force
AB initial measurement of the displacement of the stem
AB1 initial value of displacement
ab1 initial type value of displacement
ab1-max initial type value of maximum displacement
ab1-min initial type value of minimum displacement
ac acceptable initial interval of initial type values of displacement
ad acceptable initial interval of initial type values of traction force;
B intermediate stage of the application of the traction force;
b intermediate type stage
BA intermediate measurement of the traction force
BA-nBA intermediate measurements of traction force
BA1 intermediate value of traction force
ba1 intermediate type value of traction force
ba1-ban intermediate type values of traction force
BA1-BAn successive intermediate value of traction force
ba1(max)-ban(max) intermediate type value of maximum traction force
ba1(min)-ban(min) intermediate type value of minimum traction force
BB intermediate measurement of the displacement of the stem
BB-nBB successive intermediate measurements of displacement
BB-nBB intermediate measurements of displacement
BB1 intermediate value of displacement
bb1 intermediate type value of displacement
bb1-bbn plurality of consecutive intermediate type values of displacement
BB1-BBn successive intermediate values of displacement
bb1(max)-bbn(max) intermediate type value of maximum displacement
bb1(min)-bbn(min) intermediate type value of minimum displacement
bc1-bcn acceptable intermediate interval of intermediate type values of displacement,
bd1-bdn acceptable intermediate interval of intermediate type values of traction force;
C terminal stage of the application of the traction force;
CA terminal measurement of the traction force
CA1 terminal value of traction force
ca1 terminal type value of traction force
ca1-max maximum terminal type value
ca1-max terminal type value of maximum traction force
ca1-min terminal type value of minimum traction force
CB terminal measurement of the displacement of the stem
CB1 terminal value of displacement
cb1 terminal type value of displacement
cb1-min terminal type value of minimum displacement
cc acceptable terminal interval of terminal type values of displacement
cd acceptable terminal interval of terminal type values of traction force X coordinate of measured displacement values
Y coordinate of measured traction force values

DESCRIPTION OF THE PREFERRED FORM OF EMBODIMENT

FIG. 1 shows an embodiment of a blind rivet 3 of the type to which the present invention can be applied, which comprises a body 3*a* with an interior passage 3*b*, a deformable free end part 3*c* and an end part with a rivet head 3*d* in the form of a collar, along with a stem 3*e*. The stem 3*e* is displaceable inside the interior passage 3*b* by application of a traction force and comprises a stem body 3*f* with a free end 3*g* that projects from the rivet head 3*d*. In one of its ends, the stem is provided with a stem head 3*h* which has dimension greater than the interior passage 3*b* but no greater that the contour of the first free end part 3*c* of the body of the rivet 3*a*, and which, prior to riveting, projects from the free end part 3*c* of the body of the rivet 3*a*.

Figure 2:
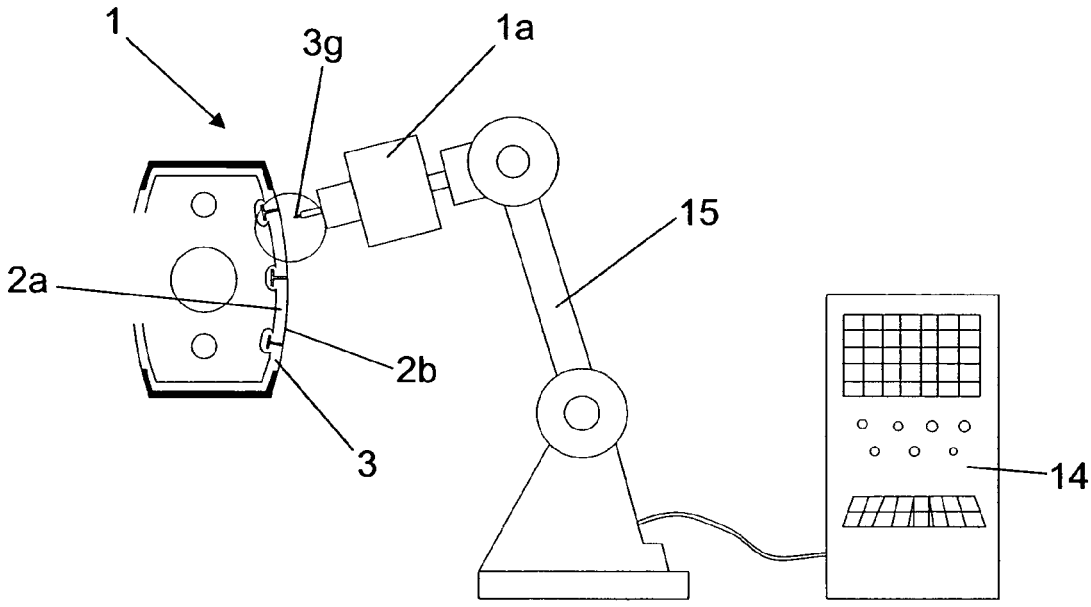
FIG. 2 schematically shows an example in a riveting facility in which the present invention can be applied.

FIG. 2 shows a riveting facility 1 which comprises a riveting apparatus 1*a* in the form of a headstock mounted on a robot 15 and a control unit 14. This facility is in itself conventional in the aeronautical industry in the assembly of torsion boxes for wings and horizontal stabilisers, where an external lining 2*b* is joined to an internal rib 2*b* by means of applying blind rivets 3. The control unit 14 contains a governing programme by means of which the robot 15 positions the headstock 1*a* in predetermined riveting positions and orders the headstock 1*a* to carrying out the riveting in those positions. The control unit 14 incorporates, in a way that is in itself conventional, a numerical control unit of sufficient precision, repetitiveness and rigidity duly programmed for locating itself in front of the unit to rivet, which already has the drill-holes previously made under the required conditions, in such a way that the headstock 1*a* can introduce the blind rivets, perpendicularly adjust them to the surface and fire the traction mechanism for the stem. The positioning system can be based, in a way that is in itself conventional, on a PC plus PLC, which contains the positioning control software with analogue and logic inputs and outputs, normally linked to the actual control of the robot 15.

Figure 3:
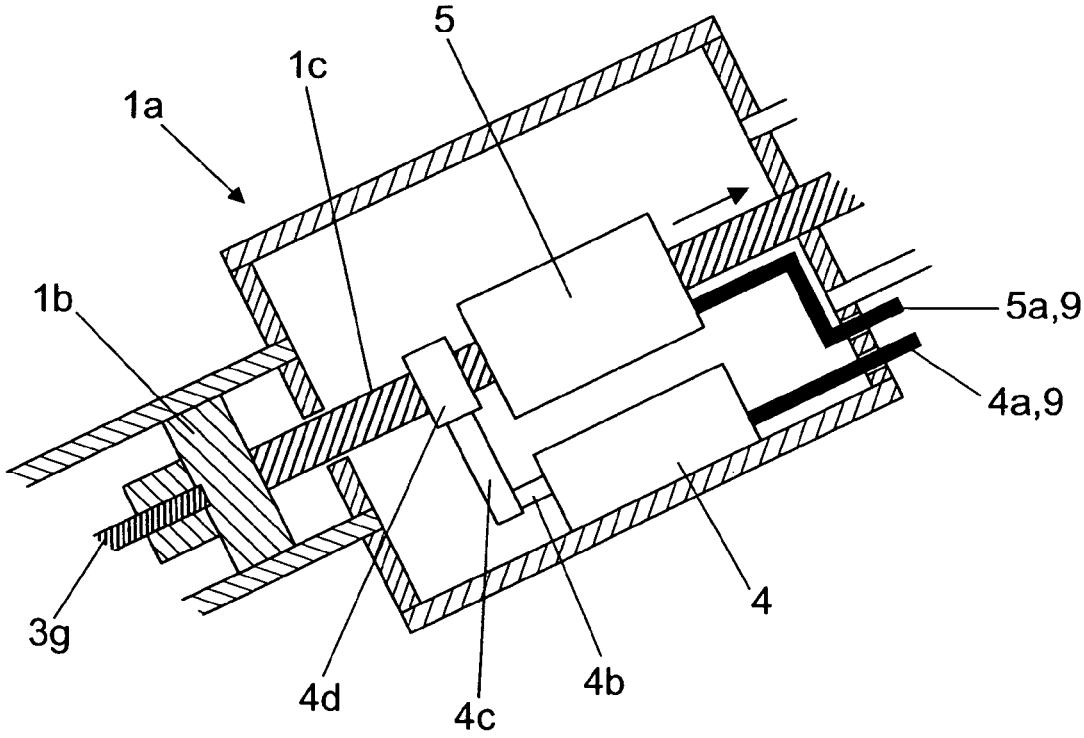
FIG. 3 schematically shows in partially sectioned lateral view an example of a riveting headstock in which the present invention can be applied.

As can be seen in FIG. 3, the riveting headstock 1*a* comprises, in a way that is in itself conventional, a securing mechanism 1*b* for securing the free end 3*g* of the body 3*f* of the stem 3*e* of the rivet. The securing mechanism 1*b* is connected to a traction rod 1*c* that can be actuated in a way that is in itself conventional by means of a traction mechanism (not shown in the figures). In accordance with the invention, the traction rod 1*c* is connected to a displacement meter 4 and to a displacement meter 5. The displacement meter 4 is a resistive meter in itself conventional, and includes a displaceable rod 4*b* coupled to the traction rod 1*c* by means of a union arm 4*c* and a coupling element 4*d*. By means of this coupling the displaceable rod 4*b* follows the movements of the traction rod 1*c*, in such a way that the meter 4 can measure the displacement of the traction rod 1*c* and transmit the measurement via the electrical connection 4*a* to a verifying device of the type shown in FIG. 5. Likewise, the electrical connections also include means of transmission 9 for signals by which the meters 4, 5 receive the orders to carry out their respective measurements. Moreover, the traction force meter 5, also connected to the traction rod 1*c*, is in itself conventional and generates an analogue signal in the appropriate stress range and transmits it to the verifying device via the electrical connections 5*a*.

Figure 4:
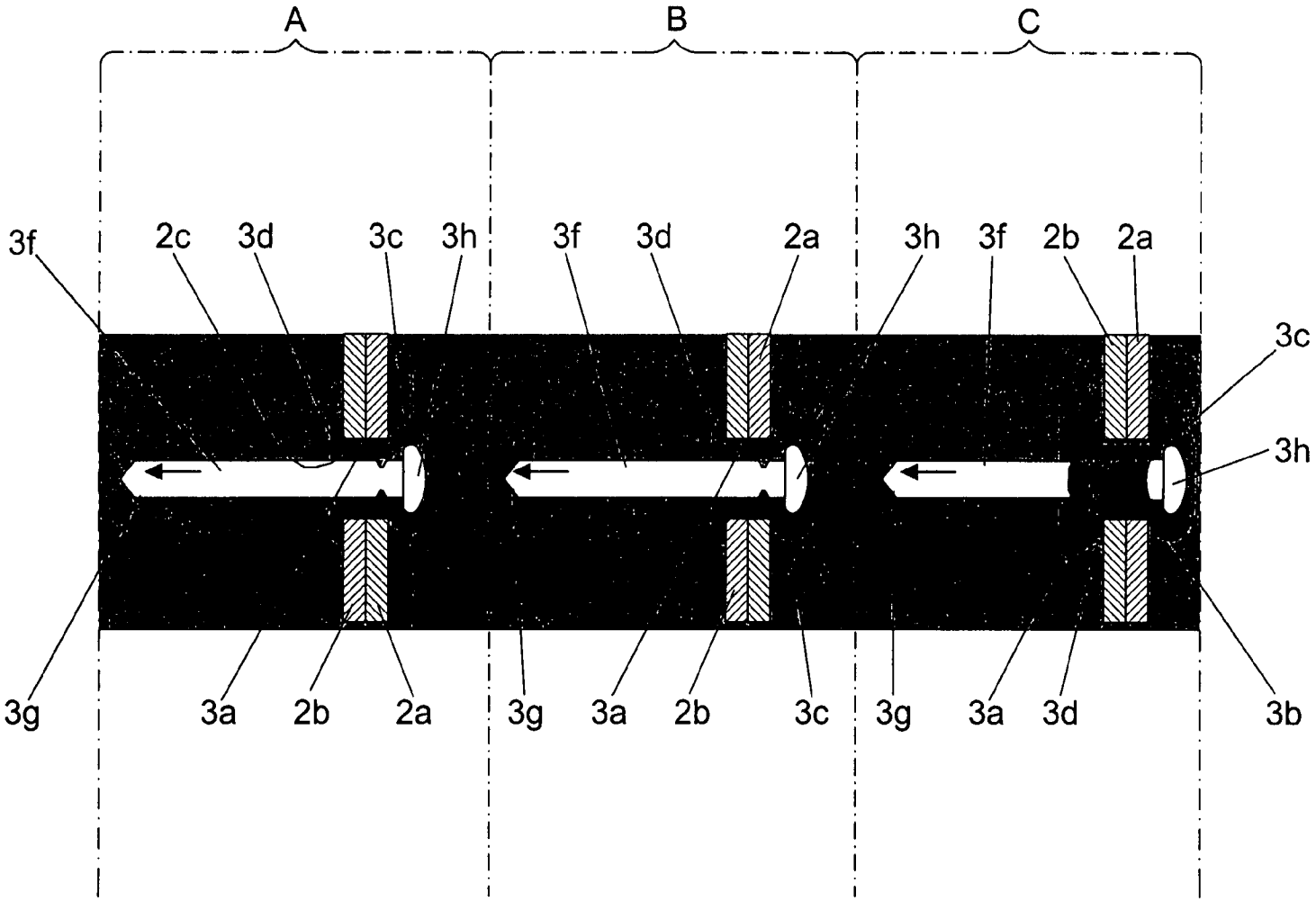
FIG. 4 schematically shows the stages, in themselves conventional, of riveting a blind rivet for the joining of two pieces.

FIG. 4 shows the development of a riveting process in itself conventional, starting from a blind rivet 3 whose rivet body 3*a* is inserted in a drill-hole 2*c* which traverses an internal piece 2*a* and an external piece 2*b* in such a way that the free end part 3*c* of the rivet projects from the internal piece 2*a* and the collar of the rivet head 3*d* remains resting on the external piece 2*b*. So, FIG. 4 shows that, when a traction force is applied to the free end 3*g* of the stem 3*f* of the blind rivet by means of riveting apparatus (not shown in FIG. 4) which simultaneously presses the collar against the exterior piece 2*b* in an initial stage A, the head 3*h* of the stem enters into the interior passage 3*b* in the free end part 3*c* of the body of the rivet 3*a* deforming the free end part 3*c* until widening it beyond the contour of the drill-hole 2*c*. As the traction force continues to be applied, in a second stage B the free end part 3*c* closes around the head 3*h* of the stem and wraps and press it, while in a final stage C part of the body 3*g* of the stem 3*f* of the head 3*h* of the stem 3*e* becomes separated.

Figure 5:
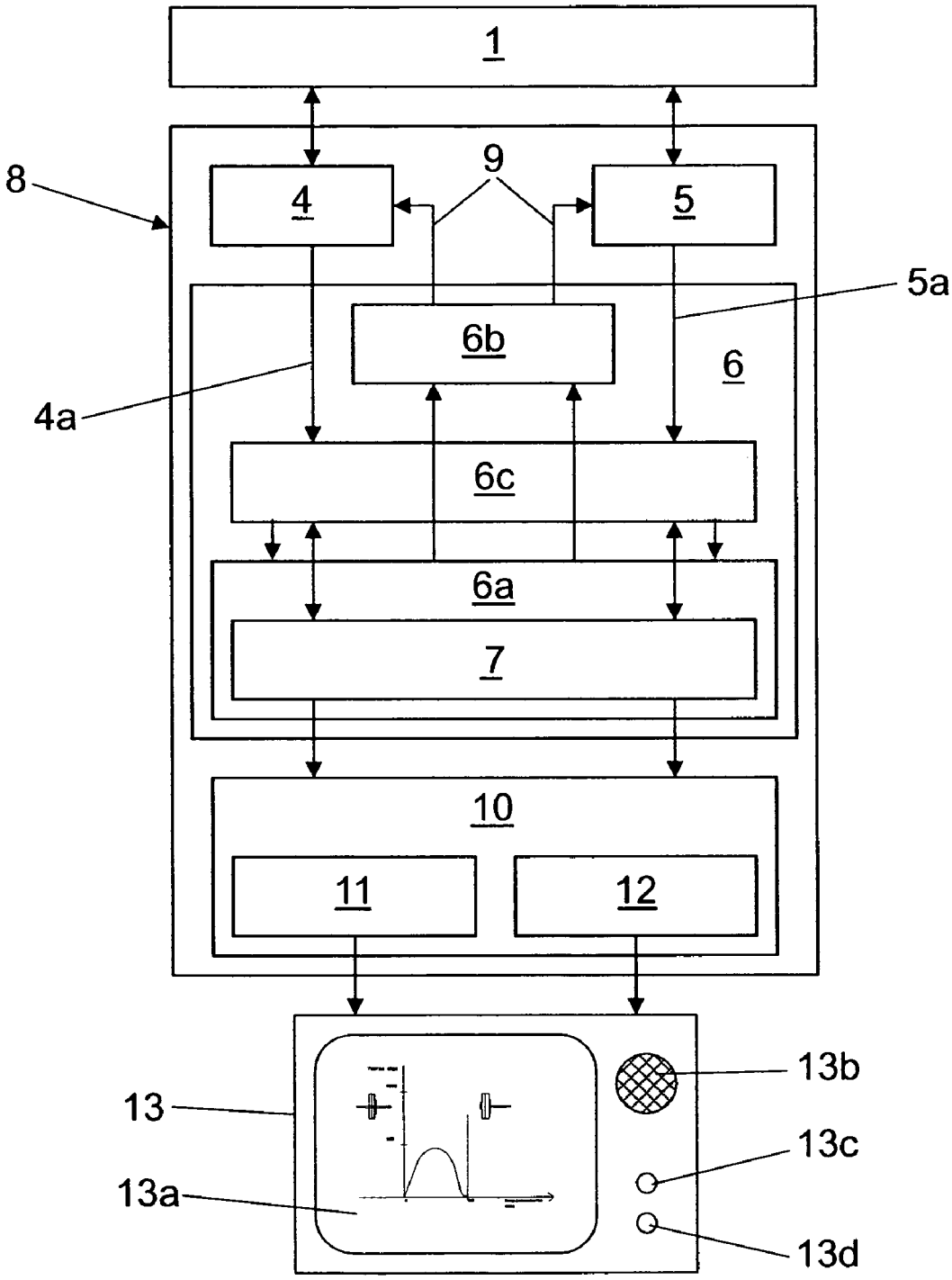
FIG. 5 schematically shows an embodiment of the inventive device.

In the embodiment of the verifying device 8 for the dynamic verification of the state of riveting of blind rivets carried out with an automatic riveting apparatus shown in FIG. 5, the traction force meter 4 is connected to the riveting apparatus 1 in order to measure successive values of a traction force applied to the stem 3*e* of the blind rivet 3, and the displacement meter 5 is connected to the riveting apparatus 1*a* in order to measure successive values of displacement of the stem 3*e* of the blind rivet 3 to which the traction force is applied with respect to the body 3*a* of the blind rivet 3. Moreover, the verifying device includes data processing means 6 with a memory 6*a* in which is stored at least one type assignment table 7, transmitter means (4*a*, 5*a*) for transmitting the values measured by the meters 4, 5 to the data processing means 6, controlling means 6*b* for ordering the displacement meter 5 and the traction force meter 4 to simultaneously carry out successive measurements during the application of the traction force to the stem 3*e*, and signalling means 10 for signalling at least one measured value that does not coincide with its corresponding type value or type values. Likewise, the verifying device includes comparing means 6*c* for respectively comparing the initial measured values, the intermediate measured values and the terminal measured values with the initial type values, the intermediate type values and the terminal type values included in the assignment table 7. The results of the comparison can be stored in the memory 6*a* for the purposes of being able to draw up a results report.

In accordance with this embodiment of the invention, the signalling means 10 includes generator means of graphic representations 11 for generating a graphic representation of the values measured in the riveting of each blind rivet in a system of coordinates with a first coordinate of measured values of displacement and a second coordinate of measured values of traction force. To achieve this, the generator means of graphic representations 11 are adapted for generating, in the system of coordinates, a graphic representation of, the type values contained in the type assignment table. The system of coordinates and the graphic representation are shown on the screen 13*a* of a monitor 13 in which are also incorporated a loudspeaker 13*b*, an indicator light for confirmation of correct location 13*c* of the rivet and an indicator light alert for incorrect location 13*d* of the rivet which are connected to means for generation of alert signals 12 incorporated into the signalling means 10 which generate alert signals when a measured value does not coincide with at least one corresponding type value. These signals result in an acoustic alert signal emitted by the loudspeaker 13*b* and/or a light alert signal emitted by the indicator light for incorrect location 13*d*.

FIG. 6 illustrates a first embodiment of the assignment table 7 contained in the memory 6*a*, in which an initial type value of displacement (ab1) is assigned to an initial type value of traction force (aa1) applied in an initial type stage (a), a plurality of consecutive intermediate type values (bb1-bbn) are assigned to respective consecutive intermediate type values of traction force (ba1-ban) consecutively applied in the intermediate type stage (B);

a terminal type value of displacement (cb1) is assigned to a terminal type value of traction force (ca1).

The type values (aa1, ab1, ba1-ban, bb1-bbn, ca1, cb1) correspond to a type riveting corresponding to the riveting carried out with a standard blind rivet corresponding to the blind rivet 3 which is applied by means of a standard riveting apparatus corresponding to the riveting apparatus 1 that is used.

The processing means include controlling means 6*b*, for example in the form of a control programme, which, via the electrical connection means 9, order the meters 4, 5 to carry out successive and respective measurements of the traction force applied and of the displacement achieved in the initial stage A, the intermediate stage B and the terminal stage C of the application of the traction force. In the embodiment with the assignment table shown in FIG. 6, these measurements include, in the initial stage A, an initial measurement of the traction force (AA) in order to obtain an initial value of traction force (AA1), and simultaneously an initial measurement of the displacement (AB) of the stem 3*e* with respect to the body 3*a* of the rivet 3 in order to obtain an initial value of displacement (AB1), said initial measurements (AA, BB) being carried out in an initial stage (A) of the application of the traction force;

in the intermediate stage B, a plurality of successive intermediate measurements of displacement (BB-nBB) in order to obtain a plurality of successive intermediate values of displacement (BB1-BBn) of the stem 3*e* with respect to the body 3*a* of the rivet 3 and to carry out simultaneously with each one of the intermediate measurements of displacement (BB-nBB) each intermediate measurements of displacement (BA-nBA) in order to obtain each successive intermediate values of traction force;

in the terminal stage C, a terminal measurement of the traction force (CA) in order to obtain a terminal value of traction force (CA1), and simultaneously a terminal measurement of the displacement (CB) of the stem 3*e* with respect to the body 3*a* of the rivet 3 in order to obtain a terminal value of displacement (CB1), said terminal measurements (CA, CB) being carried out in a terminal stage (C) of the application of the traction force.

The comparing means (6*c*) respectively compare the initial measured values (AA1, AB1), the successive intermediate measured values (BA1-BAn, BB1-BBn) and the terminal measured values (CA1, CB1) with the initial type values (aa1, ab1), with the consecutive intermediate type values of the assignment table (ba1-ban, bb1-bbn) and with the terminal type values (ca1, cb1) included in the assignment table 7. In turn, the signalling means 10 are adapted for detecting and signalling at least each measured value which does not coincide with at least one corresponding type value.

FIG. 7 illustrates a second embodiment of the assignment table 7 contained in the memory 6, which includes, with respect to the initial type value of displacement (ab1) of the stem 3*a* of the blind rivet 3 with respect to its body 3*a*, an initial type value of minimum displacement (ab1-min) and an initial type value of maximum displacement (ab1-max) which define an acceptable initial interval (ac) of initial type values of displacement, and also, with respect to each initial type value of traction force (aa1), an initial type value of minimum traction force (aa1-min) and an initial type value of maximum traction force (aa1-max) which define an acceptable initial interval (ad) of initial type values of traction force;

with respect to each intermediate type value of displacement (bb1-bbn) of the stem 3*a* of the blind rivet 3 with respect to its body 3*a*, an intermediate type value of minimum displacement (bb1(min)-bbn(min)) and an intermediate type value of maximum displacement (bb1(max)-bbn(max)) which define an acceptable intermediate interval (bc1-bcn) of intermediate type values of displacement, and also, with respect to each intermediate type value of traction force (ba1-ban), an intermediate type value of minimum traction force (ba1(min)-ban(min)) and an intermediate type value of maximum traction force (ba1(max)-ban(max)) which define an acceptable intermediate interval (bd1-bdn) of intermediate type values of traction force; and with respect to the terminal type value of displacement (cb1) of the stem 3*a* of the blind rivet 3 with respect to its body 3*a*, a terminal type value of minimum displacement (cb1-min) and a terminal type maximum value (cb1-max) which define an acceptable terminal interval (cc) of terminal type values of displacement, and also, with respect to each terminal type value of traction force (ca1), a terminal type value of minimum traction force (ca1-min) and a terminal type value of maximum traction force (ca1-max) which define an acceptable initial interval (cd) of initial type values of traction force.

Figure 8:
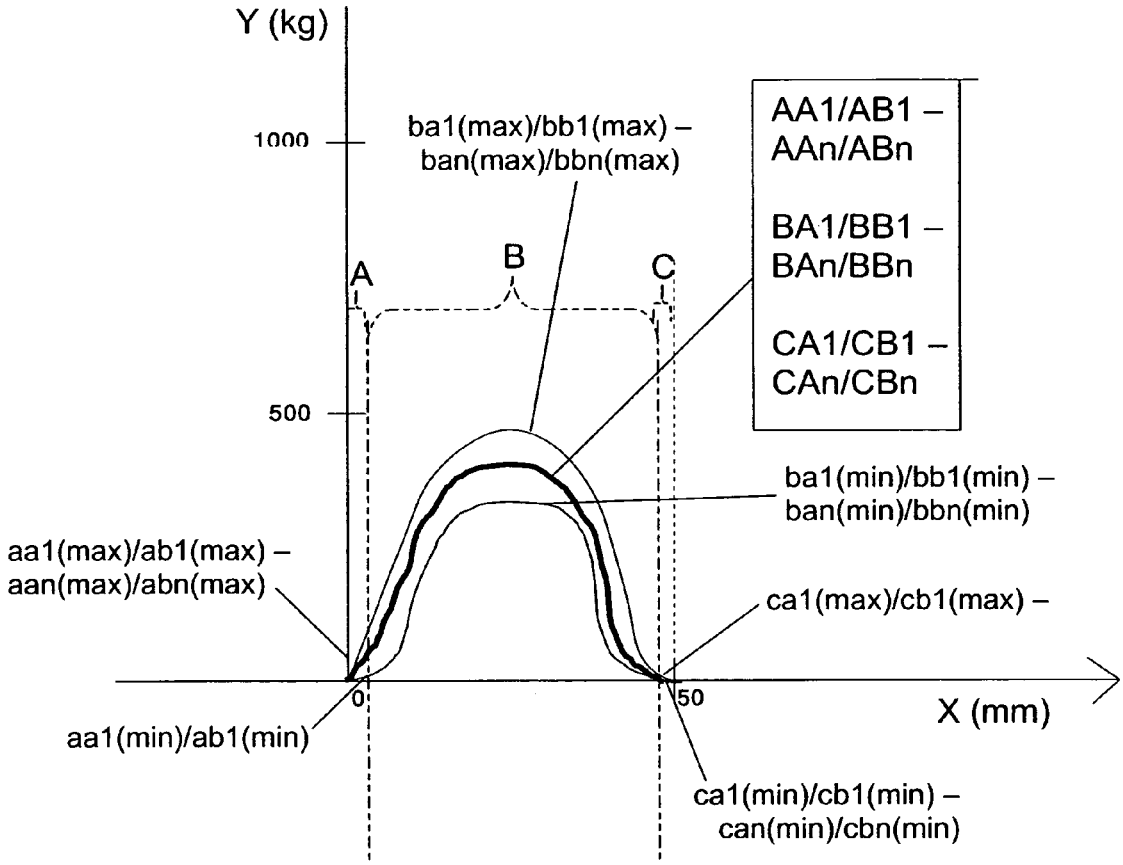
FIG. 8 is a schematic view of an embodiment of a graphic representation which can be generated in accordance with the present invention.

In this embodiment, the comparing means (6*c*) respectively compare the initial measured values (AA, AB), the intermediate measured values (BA1-BAn, BB1-BBn) and the terminal measured values (CA, CB) with the acceptable initial intervals (ac, ad), the acceptable intermediate intervals (bc1-bcn, bd1-bdn) and the acceptable terminal intervals (cc, cd), and the signalling means 10 are adapted to signal at least each measured value that does not lie in its corresponding acceptable interval. FIG. 8 shows a graphic representation in a system of coordinates X (=displacement in mm) and Y (=applied traction force)

the curve consisting of the measured values (AA1/AB1)-(AAn/Abn), (BA1/BB1)-(BAn/BBn), (CA1/CB1-CAn/CBn), the curve corresponding to the minimum type values (aa1(min)/ab1(min)), (ba1(min)/bb1(min-ban(min)/bbn(min)), (ca1(min)/cb1(min)).

the curve corresponding to the maximum type values (aa1(min)/ab1(min)), (ba1(max)/bb1(max-ban(max)/bbn(max)), (ca1(min)/cb1(min)).

It can be seen that in the case that is represented, the curve of the measured values lies between the maximum and minimum type values, and is therefore representative of the correct application of the rivet.

The invention claimed is:

1. A dynamic verification method for a riveting process with blind rivets carried out with an automatic riveting apparatus (1*a*) for joining at least one internal piece (2*a*) with at least one external piece (2*b*), where the method is applicable to a blind rivet (3) which comprises a body (3*a*) with an interior passage (3*b*), a deformable free end part (3*c*) and an end part with a collar-shaped rivet head (3*d*), along with a stem (3*e*) which is displaceable inside the interior passage (3*b*) by application of a traction force and that comprises a stem body (3*f*) with a free end (3*g*) that projects from the rivet head (3*d*) and an end with a stem head (3*h*) which has a dimension greater than said interior passage (3*b*) but no greater than a contour of said deformable free end part (3*c*) of the body of the rivet (3*a*), and which, prior to riveting, projects from the free end part (3*c*) of the body of the rivet (3*a*), the riveting process comprising applying a traction force to the free end (3*g*) of the stem body (3*f*) of the blind rivet (3) whose rivet body (3*a*) is inserted in a drill-hole (2*c*) which traverses the internal piece (2*a*) and the external piece (2*b*) in such a way that said free end part (3*c*) projects from the internal piece (2*a*) and said collar-shaped rivet head (3*d*) remains resting on the external piece (2*b*), by means of the riveting apparatus (1) which simultaneously presses said collar-shaped rivet head (3*d*) against said exterior piece (2*b*), so that the stem head (3*h*) enters into the interior passage (3*b*) in the free end part (3*c*) of the body of the rivet (3*a*) deforming said free end part (3*c*) until widening said free end part (3*c*) beyond a contour of said drill-hole (2*c*) and until said free end part (3*c*) wraps and presses the stem head (3*h*), and separating at least part of the stem body (3*f*) from the stem head (3*h*), wherein the dynamic verification method comprises the following steps:

i) carrying out successively, during the application of the traction force to the stem (3*e*) the following stages in an initial stage A, carrying out an initial measurement of the traction force (AA) by means of a traction force meter (4) connected to the riveting apparatus (1) in order to obtain an initial value of traction force (AA1), and simultaneously carrying out an initial measurement of the displacement (AB) of the stem (3*e*) with respect to the body (3*a*) of the rivet (3) in order to obtain an initial value of displacement (AB1) by means of a displacement meter (5) connected to the riveting apparatus (1), in an intermediate stage B, carrying out at least one intermediate measurement of the traction force (BA) by means of a traction force meter (4) connected to the riveting apparatus (1) in order to obtain an intermediate value of the traction force (BA1), simultaneously carrying out an intermediate measurement of the displacement (BB) of the stem (3*e*) with respect to the body (3*a*) of the rivet (3) in order to obtain an intermediate value of the displacement (BB1) by means of a displacement meter (5) connected to the riveting apparatus (1) and transmitting at least one intermediate measurement of the traction force (BA) and the intermediate measurement of the displacement (BB) to a processing means (6), and in a terminal stage C, carrying out a terminal measurement of the traction force (CA) by means of a traction force meter (4) connected to the riveting apparatus (1) in order to obtain a terminal value of traction force (CA1), and simultaneously carrying out a terminal measurement of the displacement (CB) of the stem (3*e*) with respect to the body (3*a*) of the rivet (3) in order to obtain a terminal value of displacement (CB1) by means of a displacement meter (5) connected to the riveting apparatus (1);

ii) storing a type assignment table (7) in a memory (6*a*) comprised in the data processing means (6), where the type assignment table (7) comprises at least one initial type value of displacement (ab1) is assigned to at least one initial type value of traction force (aa1) applied in an initial type stage (a), at least one intermediate type value of displacement (bb1) is assigned to at least one intermediate type value of traction force (ba1) applied in an intermediate type stage (b), and at least one terminal type value of displacement (cb1) is assigned to at least one terminal type value of traction force (ca1), wherein said type values (aa1, ab1, ba1, bb1, ca1, cb1) correspond to a type riveting corresponding to the riveting that is done with a standard blind rivet corresponding to the blind rivet (3) that is applied, by means of a standard riveting apparatus corresponding to the riveting apparatus (1*a*) that is used;

iii) comparing, by means of the data processing means (6), the initial measured values (AA1, AB1), the intermediate measured values (BA1, BB1), and the terminal measured values (CA1, CB1), with the initial type values (aa1, ab1), the intermediate type values (ba1, bb1) and the terminal type values (ca1, cb1), included in the assignment table (7); and iv) signalling at least one measured value which does not match with at least one corresponding type value.

2. A method according to claim 1, wherein the type assignment table (7) includes a plurality of consecutive intermediate type values of displacement (bb1-bbn) assigned to respective consecutive intermediate type values of traction force (ba1-ban) consecutively applied in the intermediate type stage (b);

and wherein the method further comprises in the intermediate stage (B) of the application of the traction force;

carrying out a plurality of successive intermediate measurements of displacement (BB-nBB) in order to obtain a plurality of successive intermediate values of displacement (BB1-BBn) and carrying simultaneously with each one of the intermediate measurements of displacement (BB-nBB) each intermediate measurements of traction force (BA-nBA) in order to obtain successive intermediate values of traction force (BA1-BAn);

comparing the successive intermediate measured values (BA1-BAn, BB1-BBn) with consecutive intermediate type values of the assignment table (ba1-ban, bb1-bbn); and signaling at least one intermediate measured value which does not match with at least one corresponding intermediate type value.

3. A method according to claim 1, wherein the type assignment table (7) includes with respect to the initial type value of displacement (ab1), an initial type value of minimum displacement (ab1-min) and an initial type value of maximum displacement (ab1-max) which define an acceptable initial interval (ac) of initial type values of displacement, as well as, with respect to each initial type value of traction force (aa1), an initial type value of minimum traction force (aa1-min) and an initial type value of maximum traction force (aa1-max) which define an acceptable initial interval (ad) of initial type values of traction force;

with respect to each intermediate type value of displacement (bb1-bbn), an intermediate type value of minimum displacement (bb1(min)-bbn(min)) and an intermediate type value of maximum displacement (bb1(max)-bbn (max)) which define an acceptable intermediate interval (bc-bcn) of intermediate type values of displacement, as well as, with respect to each intermediate type value of traction force (ba1 ban), an intermediate type value of minimum traction force (ba1(min)-ban(min)) and an intermediate type value of maximum traction force (ba1 (max)-ban(max)) which define an acceptable intermediate interval (bd1-bdn) of intermediate type values of traction force; and with respect to the terminal type value of displacement (cb1), a terminal type value of minimum displacement (cb1-min) and a terminal type value of maximum displacement (cb1-max) which define an acceptable terminal interval (cc) of terminal type values of displacement, as well as, with respect to each terminal type value of traction force (ca1), a terminal type value of minimum traction force (ca1-min) and a terminal type value of maximum traction force (ca1-max) which define an acceptable terminal interval (cd) of terminal type values of traction force;

and wherein the initial measured values (AA, AB), the intermediate measured values (BA1-BAn, BB1-BBn) and the terminal measured values (CA, CB) are respectively compared with the acceptable initial intervals (ac, ad), the acceptable intermediate intervals (bc1-bcn, bd1-bdn) and the acceptable terminal intervals (cc, cd).

4. A method according to claim 2, wherein the type assignment table (7) includes with respect to the initial type value of displacement (ab1), an initial type value of minimum displacement (ab1-min) and an initial type value of maximum displacement (ab1-max) which define an acceptable initial interval (ac) of initial type values of displacement, as well as, with respect to each initial type value of traction force (aa1), an initial type value of minimum traction force (aa1-min) and an initial type value of maximum traction force (aa1-max) which define an acceptable initial interval (ad) of initial type values of traction force;

with respect to each intermediate type value of displacement (bb1-bbn), an intermediate type value of minimum displacement (bb1(min)-bbn(min)) and an intermediate type value of maximum displacement (bb1(max)-bbn (max)) which define an acceptable intermediate interval (bc-bcn) of intermediate type values of displacement, as well as, with respect to each intermediate type value of traction force (ba1 ban), an intermediate type value of minimum traction force (ba1(min)-ban(min)) and an intermediate type value of maximum traction force (ba1 (max)-ban(max)) which define an acceptable intermediate interval (bd1-bdn) of intermediate type values of traction force; and with respect to the terminal type value of displacement (cb1), a terminal type value of minimum displacement (cb1-min) and a terminal type value of maximum displacement (cb1-max) which define an acceptable terminal interval (cc) of terminal type values of displacement, as well as, with respect to each terminal type value of traction force (ca1), a terminal type value of minimum traction force (ca1-min) and a terminal type value of maximum traction force (ca1-max) which define an acceptable terminal interval (cd) of terminal type values of traction force;

and wherein the initial measured values (AA, AB), the intermediate measured values (BA1BAn, BB1-BBn) and the terminal measured values (CA, CB) are respectively compared with the acceptable initial intervals (ac, ad), the acceptable intermediate intervals (bc1-bcn, bd1-bdn) and the acceptable terminal intervals (cc, cd).

5. A verifying device for dynamic verification of the state of a riveting of blind rivets carried out with an automatic riveting apparatus, wherein the verifying device (8) comprises:

a traction force meter (4) connected to the riveting apparatus (1*a*) for measuring successive values (AA, BA1-BAn, CA) of a traction force applied to a stem (3*e*) of a blind rivet (3);

a displacement meter (5) connected to the riveting apparatus (1*a*) for measuring successive values (AB, BB1-BBn, CB) of the displacement of the stem (3*e*) of the blind rivet (3) to which the traction force is applied with respect to a body (3*a*) of the blind rivet (3);

data processing means (6) comprising a memory (6*a*) in which at least one type assignment table (7) is stored, the assignment table (7) having at least one initial type value of displacement (ab1) assigned to at least one initial type value of traction force (aa1) applied in an initial type stage (a), at least one intermediate type value of displacement (bb1) assigned to at least one intermediate type value of traction force (bal) applied to an intermediate type stage (b), and at least one terminal type value of displacement (cb1) assigned to at least one terminal type value of traction force (ca1), said type values (aa1, ab1, ba1, bb1, ca1, cb1) corresponding to a type riveting corresponding to the riveting that is done with a standard blind rivet corresponding to the blind rivet (3) that is applied, by means of a standard riveting apparatus corresponding to the riveting apparatus (1*a*) that is used;

transmitter means (4*a*, 5*a*) operably coupled to the displacement meter, the traction force meter, and the data processing means for transmitting the values measured by the traction force meter (4) and the displacement meter (5) to the data processing means (6);

controlling means (6*b*) operably coupled to the displacement meter and the traction force meter for ordering the displacement meter (5) and the traction force meter (4) to simultaneously carry out successive measurements (AA/AB, BA/BB-nBA/nBB, CA/CB) during the application of the traction force to the stem (3*e*), said measurements comprising an initial measurement of the traction force (AA) in order to obtain an initial value of traction force (AA1), and simultaneously an initial measurement of the displacement (AB) of the stem (3*e*) with respect to the body (3*a*) of the rivet (3) in order to obtain an initial value of displacement (AB1), said initial measurements (AA, BB) being carried out in an initial stage (A) of the application of the traction force, at least one intermediate measurement of the traction force (BA) in order to obtain an intermediate value of traction force (BA1), and simultaneously an intermediate measurement of the displacement (BB) of the stem (3*e*) with respect to the body (3*a*) of the rivet (3) in order to obtain an intermediate value of the displacement (BB1), said intermediate measurements (BA, BB) being carried out in an intermediate stage (B) of the application of the traction force, and a terminal measurement of the traction force (CA) in order to obtain a terminal value of traction force (CA1), and simultaneously a terminal measurement of the displacement (CB) of the stem (3*e*) with respect to the body (3*a*) of the rivet (3) in order to obtain a terminal value of displacement (CB1), said terminal measurements (CA, CB) being carried out in a terminal stage (C) of the application of the traction force;

comparing means (6*c*) operably coupled to the traction force meter and the displacement meter for respectively comparing the initial measured values (AA1, AB1), the intermediate measured values (BA1, BB1), and the terminal measured values (CA1, CB1) with the initial type values (aa1, ab1), the intermediate type values (ba1, bb1) and the terminal type values (ca1, cb1) included in the assignment table (7); and signalling means (10) for signalling at least each measured value which does not match with at least one corresponding type value.

6. A device according to claim 5, wherein the assignment table (7) includes a plurality of consecutive intermediate type values of displacement (bb1-bbn) assigned to respective consecutive intermediate type values of traction force (ba1-ban) consecutively applied in the intermediate type stage (B);

the controlling means (6*b*) are adapted for ordering the sensors to carry out a plurality of successive intermediate measurements of displacement (BB-nBB) in order to obtain a plurality of successive intermediate values of displacement (BB1-BBn) and carry out simultaneously with each one of the intermediate measurements of displacement (BB-nBB) each intermediate measurements of traction force (BA-nBA) in order to obtain each successive intermediate values of traction force (BA1-BAn);

the comparing means (6*c*) are adapted for comparing the successive intermediate measured values (BA1-BAn, BB1-BBn) with consecutive intermediate type values of the assignment table (ba1-ban, bb1-bbn); and the signalling means (10) are adapted for signalling at least each intermediate measured value which does not match with at least one corresponding intermediate type value.

7. A device according to claim 5, wherein the type assignment table (7) further comprises:

with respect to the initial type value of displacement (ab1), an initial type value of minimum displacement (ab1-min) and an initial type value of maximum displacement (ab1-max) which define an acceptable initial interval (ac) of initial type values of displacement, as well as, with respect to each initial type value of traction force (aa1), an initial type value of minimum traction force (aa1-min) and an initial type value of maximum traction force (aa1-max) which define an acceptable initial interval (ad) of initial type values of traction force;

with respect to each intermediate type value of displacement (bbl-bbn), an intermediate type value of minimum displacement (bb1(min)-bbn(min)) and an intermediate type value of maximum displacement (bb1(max)-bbn (max)) which define an acceptable intermediate interval (bc1-bcn) of intermediate type values of displacement, as well as, with respect to each intermediate type value of traction force (ba1-ban), an intermediate type value of minimum traction force (ba1(min)-ban(min)) and an intermediate type value of maximum traction force (ba1 (max)-ban(max)) which define an acceptable intermediate interval (bd1-bdn) of intermediate type values of traction force; and with respect to the terminal type value of displacement (cb1), a terminal type value of minimum displacement (cb1-min) and a terminal type value of maximum displacement (cb1-max) which define an acceptable terminal interval (cc) of terminal type values of displacement, as well as, with respect to each terminal type value of traction force (ca1), a terminal type value of minimum traction force (ca1-min) and a terminal type value of maximum traction force (ca1-max) which define an acceptable terminal interval (cd) of terminal type values of traction force;

and wherein the comparing means (6*c*) respectively compare the initial measured values (AA, AB), the intermediate measured values (BA1-BAn, BB1-BBn) and the terminal measured values (CA, CB) with the acceptable initial values (ac, ad), the acceptable intermediate values (bc1-bcn, bd1-bdn) and the acceptable terminal values (cc, cd).

8. A device according to claim 5, wherein the signalling means (10) include generator means for graphic representations (11) in order to generate a graphic representation of the values measured in the riveting of each blind rivet (3) in a system of coordinates (X, Y) consisting of a first coordinate (X) of measured values of displacement (AB1, BB1-BBn, CB1) and a second coordinate (Y) of measured values of traction force (AA1, BA1-BAn, CA1).

9. A device according to claim 8, wherein the generator means for graphic representations (11) are adapted in order to generate, in said system of coordinates (X, Y), a graphic representation of the type values (aa1 , ab1, ba1-ban, bb1-bbn, ca1, cb1) contained in the type assignment table.

10. A device according to claim 5, further comprising means for generation of an alert signal (12) which generates an alert signal when a measured value does not match with at least one corresponding type value.

11. A device according to claim 10, wherein the alert signal is selected from between acoustic signals, visual signals and combinations of them.

12. A device according to claim 6, wherein the type assignment table (7) comprises with respect to the initial type value of displacement (ab1), an initial type value of minimum displacement (ab1-min) and an initial type value of maximum displacement (ab1-max) which define an acceptable initial interval (ac) of initial type values of displacement, as well as, with respect to each initial type value of traction force (aa1), an initial type value of minimum traction force (aa1-min) and an initial type value of maximum traction force (aal-max) which define an acceptable initial interval (ad) of initial type values of traction force;

with respect to each intermediate type value of displacement (bb1-bbn), an intermediate type value of minimum displacement (bb1(min)-bbn(min)) and an intermediate type value of maximum displacement (bb1(max)-bbn (max)) which define an acceptable intermediate interval (bc1-bcn) of intermediate type values of displacement, as well as, with respect to each intermediate type value of traction force (ba1-ban), an intermediate type value of minimum traction force (ba1(min)-ban(min)) and an intermediate type value of maximum traction force (ba1 (max)-ban(max)) which define an acceptable intermediate interval (bd1-bdn) of intermediate type values of traction force; and with respect to the terminal type value of displacement (cb1), a terminal type value of minimum displacement (cb1-min) and a terminal type value of maximum displacement (cb1-max) which define an acceptable terminal interval (cc) of terminal type values of displacement, as well as, with respect to each terminal type value of traction force (ca1), a terminal type value of minimum traction force (ca1-min) and a terminal type value of maximum traction force (ca1-max) which define an acceptable terminal interval (cd) of terminal type values of traction force;

and wherein the comparing means (6*c*) respectively compare the initial measured values (AA, AB), the intermediate measured values (BA1-BAn, BB1-BBn) and the terminal measured values (CA, CB) with the acceptable initial values (ac, ad), the acceptable intermediate values (bc1-bcn, bd1-bdn) and the acceptable terminal values (cc, cd).

13. A device according to claim 6, wherein the signalling means (10) include generator means for graphic representations (11) in order to generate a graphic representation of the values measured in the riveting of each blind rivet (3) in a system of coordinates (X, Y) consisting of a first coordinate (X) of measured values of displacement (AB1, BB1-BBn, CB1) and a second coordinate (Y) of measured values of traction force (AA1, BA1-BAn, CA1).

14. A device according to claim 7, wherein the signalling means (10) include generator means for graphic representations (11) in order to generate a graphic representation of the values measured in the riveting of each blind rivet (3) in a system of coordinates (X, Y) consisting of a first coordinate (X) of measured values of displacement (AB1, BB1-BBn, CB1) and a second coordinate (Y) of measured values of traction force (AA1, BA1-BAn, CA1).

15. A device according to claim 6, further comprising means for generation of an alert signal (12) which generates an alert signal when a measured value does not match with at least one corresponding type value.

16. A device according to claim 7, further comprising means for generation of an alert signal (12) which generates an alert signal when a measured value does not match with at least one corresponding type value.

* * * * *